US007299898B2

(12) United States Patent
Husmann

(10) Patent No.: US 7,299,898 B2
(45) Date of Patent: Nov. 27, 2007

(54) PROGRESSIVE SAFETY DEVICE

(75) Inventor: Josef Husmann, Lucerne (CH)

(73) Assignee: Inventio AG, Hergiswill NW (CH)

( * ) Notice: Subject to any disclaimer, the term of this patent is extended or adjusted under 35 U.S.C. 154(b) by 0 days.

(21) Appl. No.: 11/421,176

(22) Filed: May 31, 2006

(65) Prior Publication Data

US 2007/0007083 A1 Jan. 11, 2007

(30) Foreign Application Priority Data

Jun. 17, 2005 (EP) ..... 05105374

(51) Int. Cl.
*B66B 5/02* (2006.01)
*B66B 5/12* (2006.01)

(52) U.S. Cl. ..... 187/373; 187/365; 187/366; 187/374

(58) Field of Classification Search ..... 187/373, 187/374, 375, 354, 365; 188/65.1, 171
See application file for complete search history.

(56) References Cited

U.S. PATENT DOCUMENTS

| | | | | |
|---|---|---|---|---|
| 3,509,970 | A * | 5/1970 | Gabler | 187/376 |
| 5,228,540 | A * | 7/1993 | Glaser | 187/355 |
| 6,446,769 | B1 * | 9/2002 | Kangiser et al. | 188/171 |
| 6,758,310 | B2 * | 7/2004 | Muff et al. | 187/370 |
| 6,942,070 | B2 * | 9/2005 | Ramseier et al. | 188/65.1 |
| 2004/0149524 | A1 * | 8/2004 | Mori et al. | 187/373 |

FOREIGN PATENT DOCUMENTS

| | | |
|---|---|---|
| EP | 1 205 418 | 5/2002 |
| EP | 1 283 189 | 2/2003 |
| EP | 1 449 800 | 8/2004 |
| WO | WO 00/39016 | 7/2000 |

* cited by examiner

*Primary Examiner*—Patrick Mackey
*Assistant Examiner*—Terrell Matthews
(74) *Attorney, Agent, or Firm*—Fraser Clemens Martin & Miller LLC; William J. Clemens

(57) ABSTRACT

A progressive safety device for an elevator includes a brake unit and an actuating unit. The brake unit has a first brake shoe with first spring assemblies and a triangular rotatable support with second and third brake shoes. The actuating unit has an electromagnetic actuator with a locking bolt, a guide bolt with a coaxial compression spring and an actuating arm. On actuation, the compression spring moves the actuating arm against a guide rail whereby grooves on the actuating arm create a frictional engagement with the guide rail turning the actuating arm about a swivel bearing and through a follower turning the support. With the turning motion and the engagement of one of the second and third brake shoes with the guide rail, the first brake shoe is guided against the guide rail and generates the necessary braking force on the guide rail.

10 Claims, 8 Drawing Sheets

PROGRESSIVE SAFETY DEVICE

BACKGROUND OF THE INVENTION

The present invention relates to a progressive safety device for an elevator, the elevator car and the counterweight being guided and movable on guide rails, the elevator car or the counterweight being arrestable on the guide rails by means of a braking unit with an actuating unit.

The European Patent EP 1 283 189 B1 shows a progressive safety device for an elevator car. Arranged movably on a supporting element at right angles to a guide rail that guides the elevator car is a base plate. Arranged on the base plate is at least one actuating lever and opposite this a brake shoe. When the progressive safety device is actuated, the free end of the actuating lever comes into contact with the guide rail and is moved by the component of the frictional force that arises parallel to the guide rail, into the engaged position in which the guide rail is jammed between the free end of the actuating lever and the brake shoe.

The actuating lever can be actuated by means of a slide that is rotatable about an axis and which is itself actuatable by means of a rope of a speed governor, the speed governor arresting the rope should overspeed of the elevator car occur.

Through the relative movement of the elevator car relative to the arrested rope, the slide is put into a rotating movement and actuates the actuating lever.

A disadvantage of the known device is that actuation of the progressive safety device takes place via the governor rope. Rope oscillations in the governor rope that is stretched over the entire hoistway height can cause noises in the elevator car and lead to false actuation of the progressive safety device. The speed governor is a mechanically complex fault-prone device that requires space in the hoistway headroom and in the hoistway pit. Moreover, only one speed can be monitored.

Publication WO 00/39016 shows a progressive safety device for an elevator car. Provided as an actuating device instead of the governor rope is an electromagnet. In the activated state, the electromagnet holds a first latching lever fest, which itself holds a second latching lever at one end. The other end of the second latching lever engages in a groove of a spring-loaded pin that acts on an actuating lever. Arranged on the free end of the actuating lever is a locking roller which on actuation is moveable along a side of a wedge and which is wedged with the free web of the guide rail. When the electromagnet is switched into the current-free state, the first latching lever releases the second latching lever and the second latching lever releases the pin which by means of the spring force actuates the actuating lever.

A disadvantage of this known device is that, on actuation, the spring has to accelerate the pin and the actuating lever with the blocking roller arranged on the long lever of the actuating lever. This results in long dead times until the effective braking of the elevator car. Should the power supply fail, the power supply to the electromagnets must be buffered by means of an uninterruptible power supply so that no false actuations occur. Moreover, the safety device acts in only one direction and is only suitable for actuation at low speeds.

SUMMARY OF THE INVENTION

The present invention concerns an apparatus that provides a solution for avoiding the disadvantages of the known device, and proposes a method of engaging a progressive safety device and creating a progressive safety device that is easily actuated in the downward and upward directions of travel and is easily reset.

The advantages achieved by means of the present invention are mainly that the progressive safety device can be actuated with few moving parts, as a result of which short response times can be realized. The spring needed for actuation can be kept small since only small masses have to be accelerated by the actuating spring. The progressive safety device is actuated in the upward and downward direction by the same parts, the braking force being generated by the movement of the elevator car. Resetting of the actuating parts takes place by means of the parts that brake the elevator car, the energy for resetting coming from the traveling motion of the elevator car. Manual release of the elevator car and the progressive safety device is not necessary.

The progressive safety device is actuatable with low electrical energy, an impulse sufficing for actuation. For example, a capacitor suffices as energy store in case of a power outage.

Also advantageous is that the entire progressive safety device system is arranged on the elevator car. Components arranged in the machine room or elevator hoistway such as a speed governor, a governor rope, a tension pulley, etc. are obviated. Actuation and unlocking of the progressive safety device is no longer limited to overspeed. Actuation can take place at any other car speed or even when the elevator car is stationary. Actuation, for example for servicing purposes, can also be performed by actuation of a push button.

The progressive safety device can also be used to secure the working space, for example in the hoistway headroom, actuation taking place when the elevator car is stationary or its speed is low. On actuation when stationary, the progressive safety device engages after a travel of only a few centimeters. For resetting, the elevator car is moved in the opposite direction. The braking force in the upward direction of travel is settable by means of springs arranged on the brake shoe.

In the progressive safety device for an elevator according to the present invention, the elevator car or the counterweight is arrested on the guide rails by means of a brake unit, an actuating unit having an actuating arm that creates a frictional engagement with the guide rail and can be set into a rotating motion by the movement of the car, the actuating arm moving with it a support with brake shoes of the brake unit. The actuating unit is controlled by an electric signal which is generated, for example, if the car speed deviates from a prescribed reference value.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
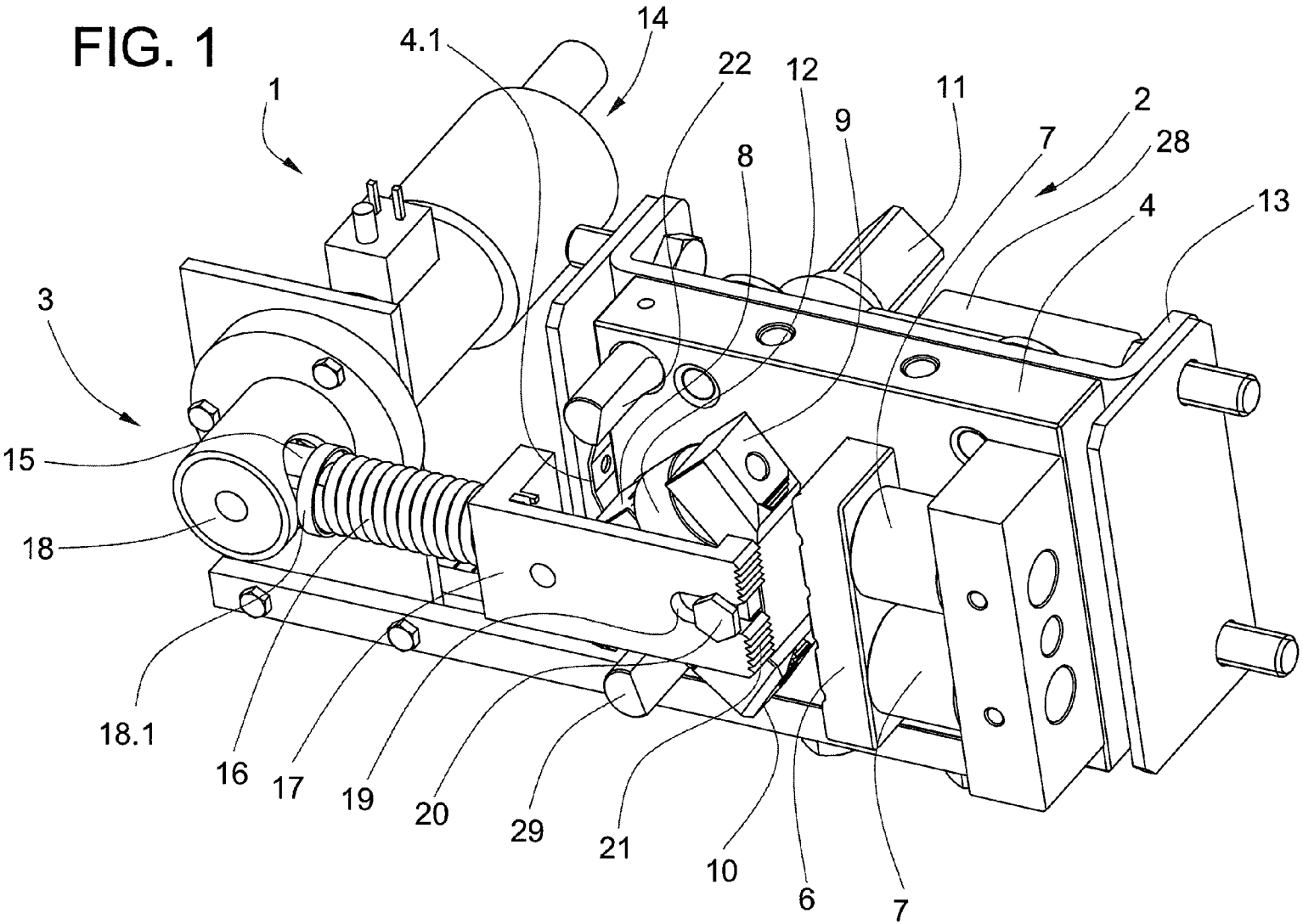
FIG. 1 is a perspective view of a progressive safety device according to the present invention.
Figure 2:
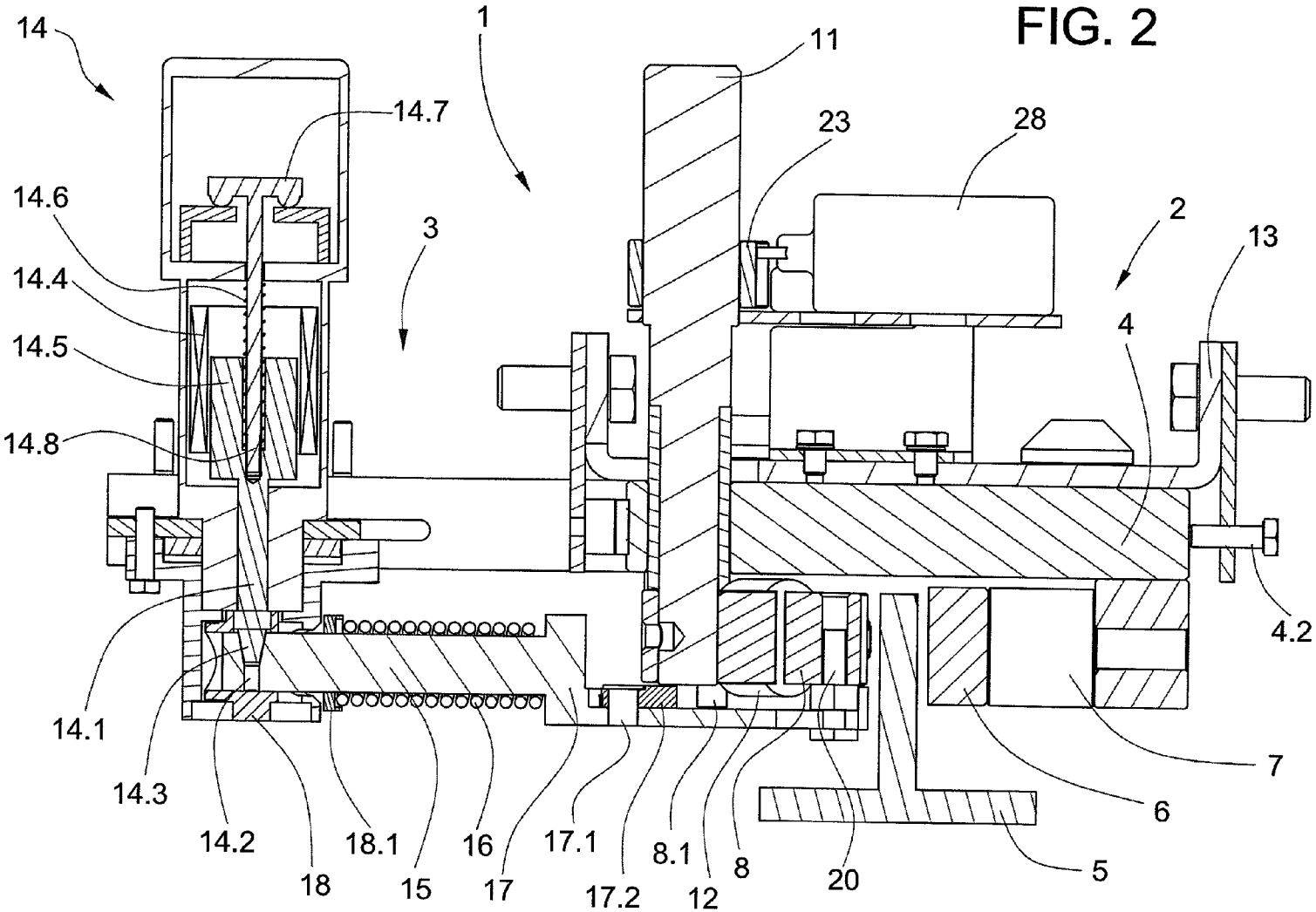
FIG. 2 is a plan view in cross section of the progressive safety device shown in FIG. 1.

FIG. 1 shows a progressive safety device 1 according to the present invention comprising a brake unit 2 and an actuating unit 3. Provided for each guide rail 5 (FIG. 2) of the elevator car is the brake unit 2 that is arranged, for example, on the sling of the elevator car. The brake unit 2 is arranged on a base plate 4 that is held in its neutral position by means of a centering spring 4.1 and a centering screw 4.2 (FIG. 2). So that no constrained forces occur, the base plate 4 is held movably relative to a mounting plate 13 by means of bolts and elongated holes. By means of the centering screw 4.2 a rail play S (FIG. 3) is set.

The brake unit 2 consists essentially of a first brake shoe 6 arranged on the base plate 4 with first spring assemblies 7 and of a triangular rotatable support 8 (FIG. 2) with a second brake shoe 9 and with a third brake shoe 10, the support 8 of the first brake shoe 6 being arranged opposite the first brake shoe 6. The first corner of the support 8 is arranged rotatably on a first shaft 11, the first shaft 11 being arranged rotatably on the base plate 4. The first shaft 11 extends as far as the opposing brake unit 2 and simultaneously actuates the support with the brake shoes of the brake unit 2.

The second brake shoe 9 is arranged on the other corner and the third brake shoe 10 on the third corner of the support 8. In case of actuation, for example on overspeed of the elevator car, the second brake shoe 9 is engaged upwardly, a second spring assembly 12 affecting the braking behavior of the elevator car or reducing the braking force. In case of actuation, for example on overspeed of the elevator car in downward direction, the third brake shoe 10 is engaged, there usually being no spring assembly to affect the braking behavior of the elevator car.

The actuating unit 3 consists essentially of an electromagnetic actuator 14 with locking bolt 14.1 (FIG. 2), a guide bolt 15 with a first compression spring 16 and an actuating arm 17, the first compression spring 16 being arranged coaxially with the guide bolt 15. The actuator 14 can also operate according to the hydraulic, pneumatic, or electromechanical principle. At one end, the guide bolt 15 is connected to a swivel bearing 18 and at the other end to the actuating arm 17, the first compression spring 16 resting at one end on the swivel bearing 18 and at the other end on the actuating arm 17. The locking bolt 14.1 of the actuator 14 releases the guide bolt 15, the compression spring 16 moving the guide bolt 15 and the actuating arm 17 in the direction of the guide rail 5. At the free end of the actuating arm 17 is an elongated slot 19 into which a bolt-like follower 20 of the support 8 projects. The actuating arm 17 can move by at least twice the rail play S relative to the follower 20. The end-face of the actuating arm 17 is provided with grooves 21.

In case of actuation, the first compression spring 16 moves the actuating lever 17 against the guide rail 5, the grooves 21 thereby creating a frictional engagement with the guide rail 5. If the elevator car is moving upward, the actuating arm 17 is moved by the frictional engagement in a clockwise direction around the swivel bearing 18 and the support 8 is rotated with it by means of the follower 20. After the second brake shoe 9 has covered twice the rail play S, the second brake shoe 9 comes into contact with the guide rail 5 and is turned further as far as a stop 29. When doing so, the first shaft 11 is turned with it and the support is turned with the two brake shoes of the opposing brake unit. With the turning motion of the second brake shoe 9, the first brake shoe 6 is guided under spring force against the guide rail 5 and generates the necessary braking force on the guide rail 5.

Figure 4:
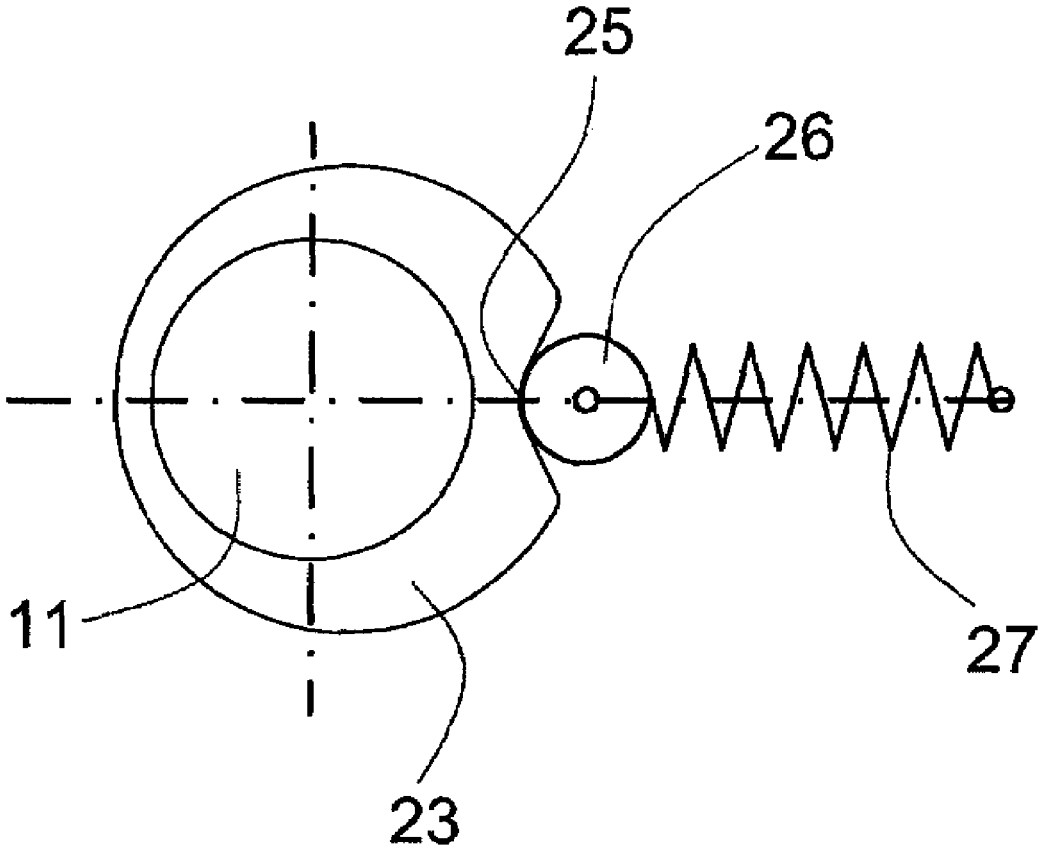
FIG. 4 is a schematic view of the resetting mechanism of the progressive safety device shown in FIG. 1.

To release the brake unit 2, the elevator car is moved in the direction opposite to the preceding direction of travel. When doing so, the support 8 with the brake shoes 9, 10 is turned back until the contact of the second brake shoe 9 with the guide rail 5 is lost. Then, as shown diagrammatically in FIG. 4, by means of a spring-loaded resetting roller 26 the support 8 is brought back into the neutral position, the resetting roller 26 rolling under the effect of a force of a second compression spring 27 into a depression 25 of a cam disk 23 arranged on the first shaft 11. The neutral position of the support 8 is monitored by means of a sensor 28. Provided as the sensor 28 is, for example, a digital comparator that monitors the position of the depression 25. The signal of the digital comparator 28 means "Brake unit engaged".

If the elevator car is moving downward, the actuating arm 17 is rotated by the frictional engagement in a counterclockwise direction around the swivel bearing 18 and the support 8 is rotated with it by means of the follower 20. After the third brake shoe 10 has covered twice the rail play S, the third brake shoe 10 comes into contact with the guide rail 5 and is turned further as far as the stop 29. The further progress of the braking operation and of the resetting operation takes place in the same upward direction as the travel of the elevator car.

On the last section of the rotating movement of the support 8, the actuating arm 17 is pushed back by means of resetting pins 8.1 (FIGS. 2 and 3) against the force of the first compression spring 16, the guide bolt 15 being thereby re-engaged with the locking bolt 14.1 of the actuator 14.

The progressive safety device 1 can be used for an elevator with an elevator car and a counterweight or for several elevators traveling in an elevator hoistway, the elevator car and the counterweight being guided on the guide rails and being connected and movable via suspension means and in case of abnormal speed being arrestable on the guide rails by means of the brake unit 2, the actuating unit 3 putting the brake unit 2 into operation. The progressive safety device 1 according to the present invention can be used for stopping the elevator car or for stopping the counterweight with selectable actuation criteria. The progressive safety device according to the present invention can also be used for an autonomously traveling self-driven ropeless or beltless elevator car (with no counterweight).

FIG. 2 shows the progressive safety device 1 in cross section with details of the actuating unit 3. At its free end, the guide bolt 15 has a conical hole 14.2 drilled crosswise into which a cone 14.3 of the locking bolt 14.1 fits. Resting on the swivel bearing 18 is a bearing ring 18.1 on which the first compression spring 16 rests. If the cone 14.3 of the locking bolt 14.1 is pulled out of the crosswise drilled hole 14.2, the compression spring 16 moves the guide bolt 15 and the actuating arm 17 in the direction of the guide rail 5. Retraction of the locking bolt 14.1 or unlocking of the brake unit 2 takes place by means of a solenoid 14.4. If the solenoid 14.4 has applied to it an electric impulse, a bolt body 14.5 is pulled into the solenoid 14.4, upon which the guide bolt 15 is released. At the same time, a pin 14.8 that is connected to the bolt body 14.5 is set into motion against a force of a third compression spring 14.6 that opens a safety contact 14.7, the interrupted signal of the safety contact 14.7 signifying "Brake unit unlocked". When the solenoid 14.4 is again without the electric signal, the locking bolt 14.1 is moved by means of the third compression spring 14.6 in the direction of the guide bolt 15 until the cone 14.3 rests against the guide bolt. The cone 14.3 can only be moved into the crosswise drilled hole 14.2 after the guide bolt 15 has returned to its starting position.

Figure 3:
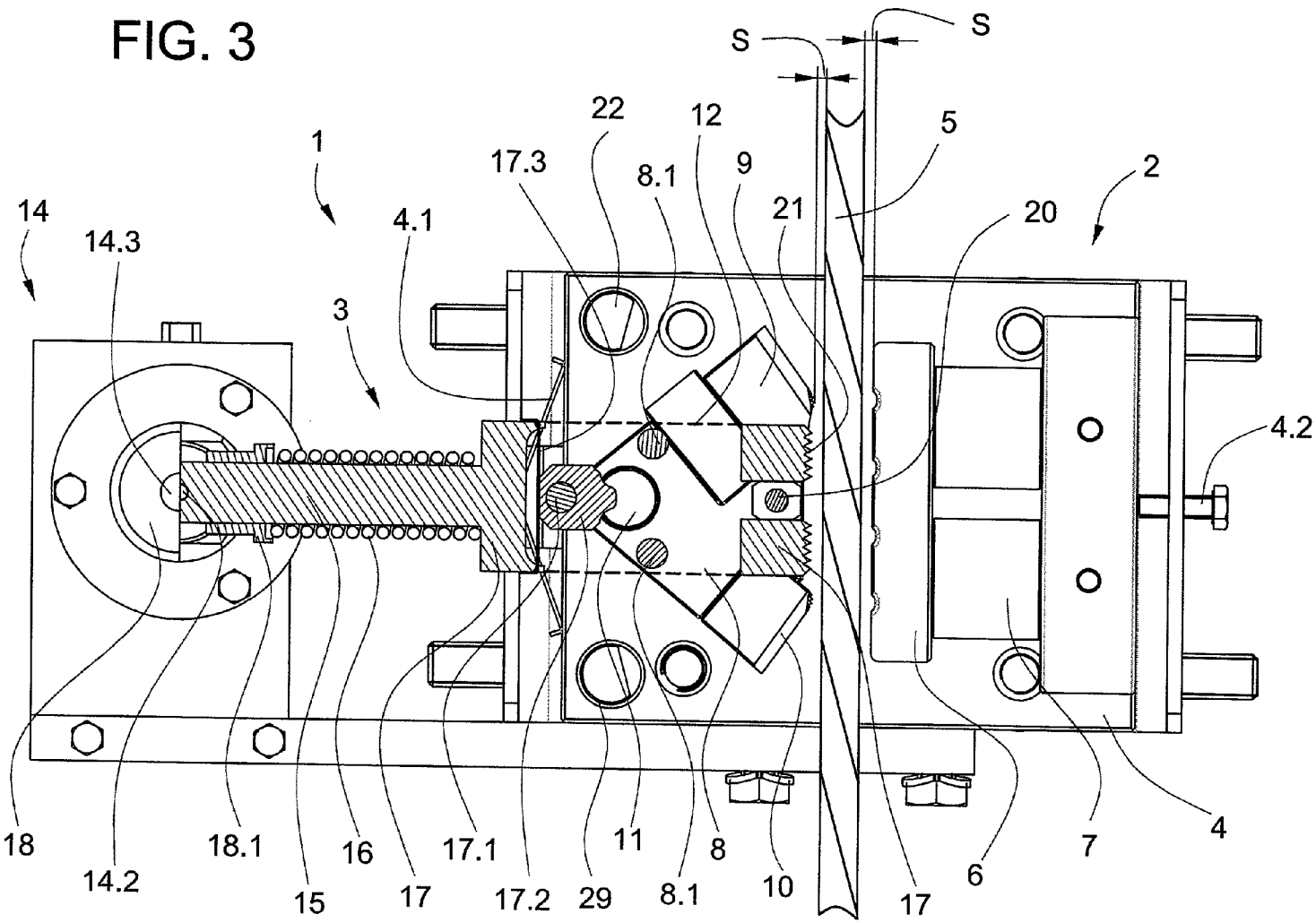
FIG. 3 is an elevation view of the progressive safety device with resetting mechanism for an actuating unit shown in FIG. 1.

FIG. 3 shows the progressive safety device 1 with the resetting mechanism for the actuating arm 17 or for the guide bolt 15. The actuating arm 17 is shown in cross section. A pressure plate 17.2 that is rotatable about a second shaft 17.1 is held in the neutral position by means of a leaf spring 17.3. The second shaft 17.1 and the leaf spring 17.3 are arranged on the actuating arm 17.

Figure 5:
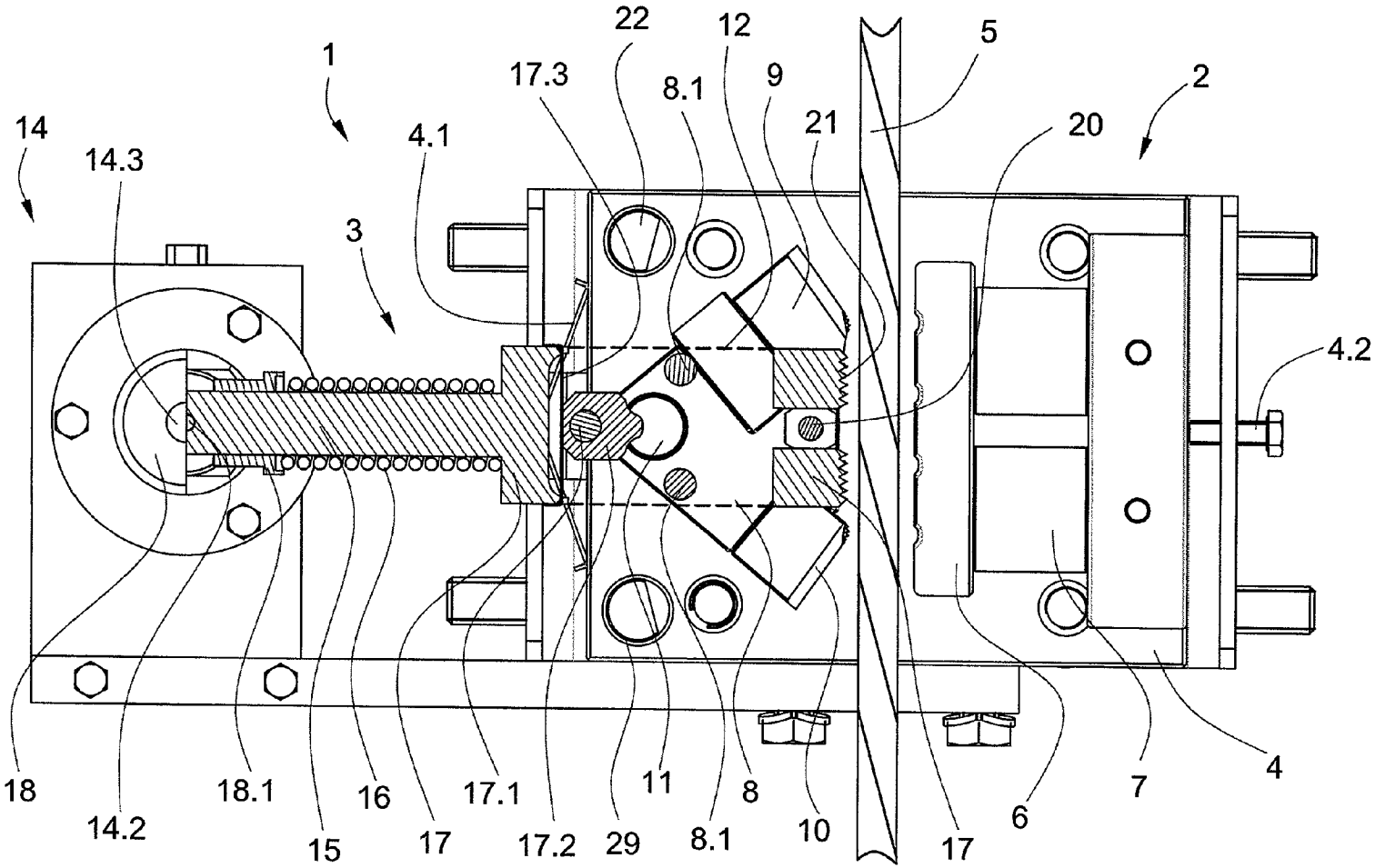
FIGS. 5 to 8 are views similar to FIG. 3 showing the engagement operation of the progressive safety device according to the present invention.
Figure 6:
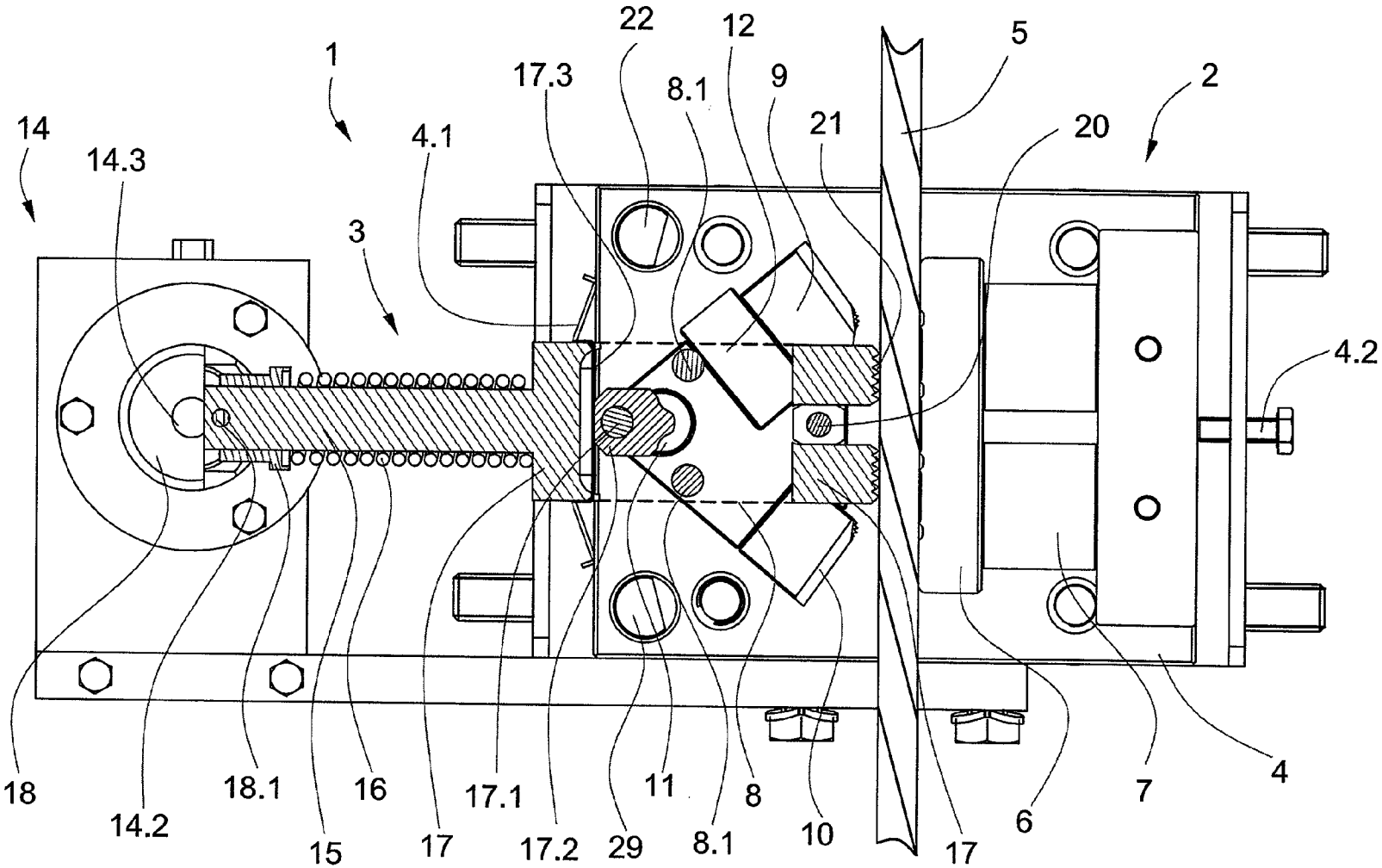
Figure 7:
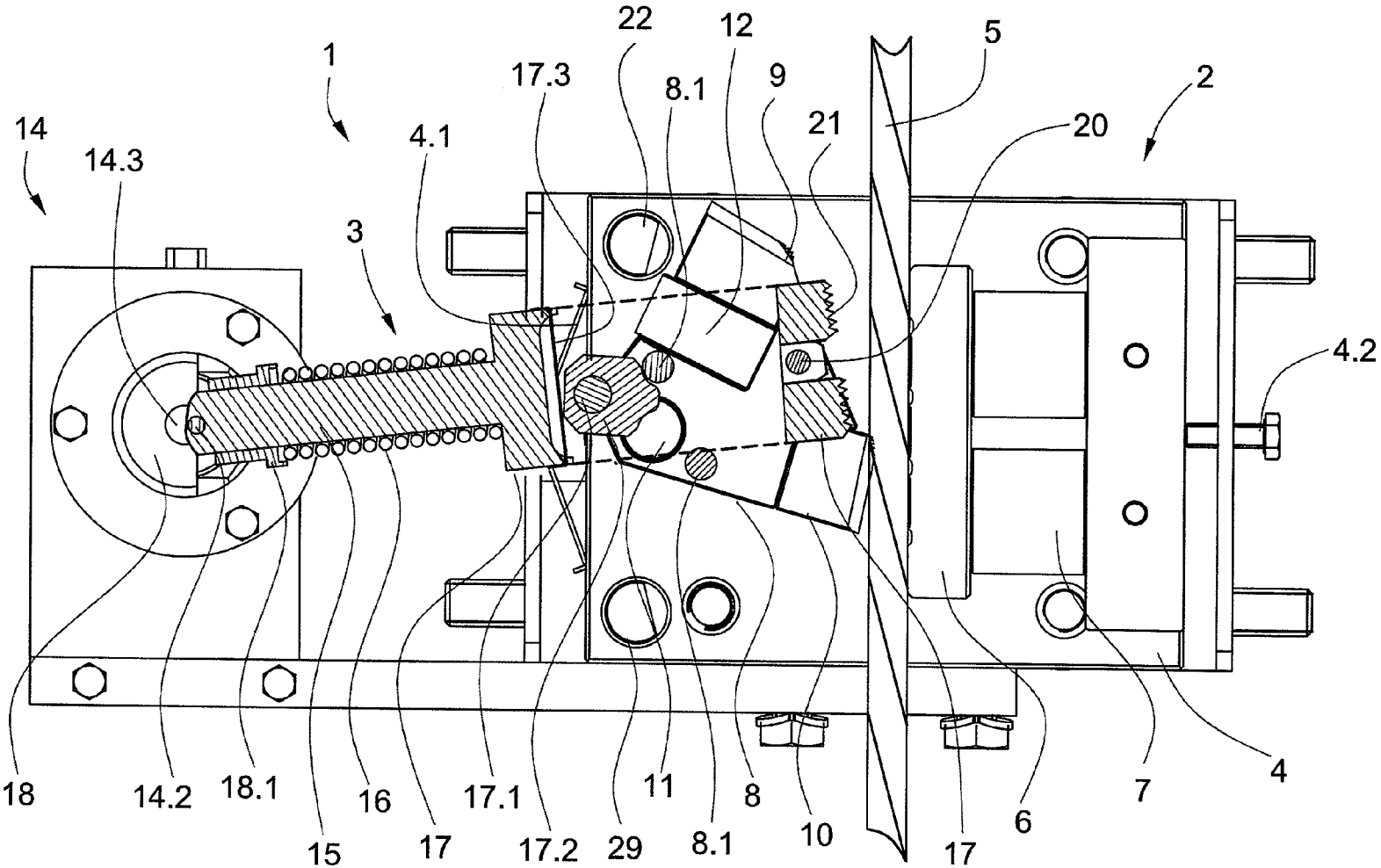
Figure 8:
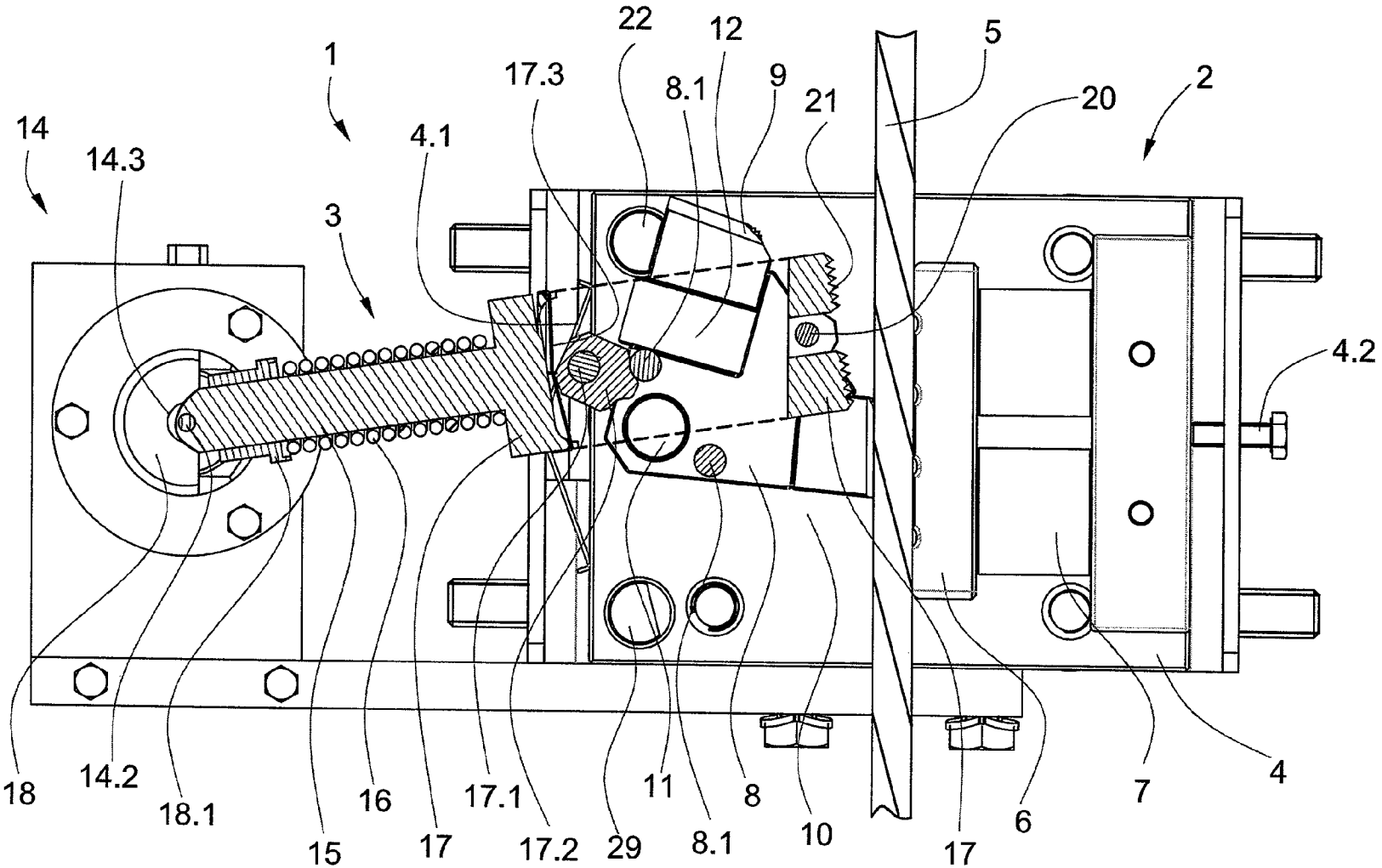

FIGS. 5 to 8 show in sequence the engaging operation of the brake unit 2 and the resetting operation of the actuating unit 3. FIG. 5 shows the brake unit 2 in the neutral position and in the locking position. The cone 14.3 of the locking bolt 14.1 holds the guide bolt 15 tight in the crosswise drilled hole 14.2. The pressure plate 17.2 is centered in the depression 25 by means of the leaf spring 17.3 and the support 8 by means of the resetting roller 26. FIG. 6 shows the position of the actuating arm 17 after the cone 14.3 has been pulled out of the crosswise drilled hole 14.2, the first compression spring 16 having guided the grooves 21 of the actuating arm 17 onto the guide rail 5. If the elevator car does not move, the brake unit 2 remains in the unlocking state shown. If the elevator car moves in a downward direction, the actuating arm 17 rotates in a counterclockwise direction about the swivel bearing 18 and by means of the follower 20, turns the support 8 about the first shaft 11 as shown in FIG. 7. Through turning of the support, the resetting pin 8.1 strikes the pressure plate 17.2 and presses the actuating arm 17 and the guide bolt 15 in the direction of the swivel bearing 18, the cone 14.3 of the locking bolt 14.1 sliding on the guide bolt 15. FIG. 8 shows the final position of the support 8 with the second brake shoe 9 against a stop 22 and the third brake shoe 10 engaged with the guide rail 5. The first brake shoe 6 is also engaged with the guide rail 5 and in conjunction with the third brake shoe 10 generates the braking force. The resetting pin 8.1 has pressed the actuating arm 17 and the guide bolt 15 so far back that the cone 14.3 slides into the crosswise drilled hole 14.2. As shown in FIG. 8, the brake unit 2 is locked again but still engaged. With a movement of the elevator car in the upward (opposite) direction, the support 8 is turned in clockwise direction and, after the third brake shoe 10 has lost contact with the guide rail 5, centered in the neutral position again by means of the resetting roller 26 rolling into the depression 25. At the same time, by means of the leaf spring 17.3 the pressure plate 17.2 is turned back into the starting position.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A progressive safety device for an elevator, an elevator car and a counterweight being guided and movable on guide rails, comprising:

a brake unit for arresting one of the elevator car or counterweight on one of the guide rails with a plurality of brake shoes; and an actuating unit for operating said brake unit, said actuating unit having an actuating arm that is moveable into frictional engagement with the one guide rail and when in frictional engagement is set in motion by movement of the elevator car, and wherein the motion of the actuating arm moves said brake shoes into contact with the guide rail.

2. The device according to claim 1 wherein one end of said actuating arm is held against a swivel bearing by a guide bolt and an opposite end of said actuating arm has grooves formed therein to improve frictional engagement with the guide rail.

3. The device according to claim 1 wherein said actuating unit includes a compression spring urging said actuating arm toward the guide rail and an actuator for releasing said actuating arm from a locked position to permit said compression spring to move said actuating arm toward the guide rail.

4. The device according to claim 3 wherein said actuating arm is held against a swivel bearing by a guide bolt and said compression spring is arranged coaxial to said guide bolt and at one end rests on said actuating arm and at an opposite end rests on a bearing ring of said swivel bearing.

5. The device according to claim 3 wherein said brake shoes are mounted on a rotatable support and turning movement of said support resets said actuating arm, said guide bolt, and said compression spring after movement toward the guide rail.

6. The device according to claim 5 including at least one resetting pin on said support for actuating a pressure plate of said actuating arm and resetting said actuating arm.

7. The device according to claim 1 wherein said brake shoes are mounted on a rotatable support and, after rotation, said support is returned to a neutral position by a spring-loaded resetting roller which is rolled by a force applied by a compression spring into a depression of a cam disk that is arranged on a first shaft of said support.

8. The device according to claim 1 including an actuator responding to an energy impulse to unlock said actuating arm from a locked position.

9. The device according to claim 8 wherein said actuator has an unlocking bolt with a cone that penetrates into a crosswise drilled hole of a guide bolt holding said actuating arm and, in response to said energy impulse, said bolt is moved to remove said cone from said hole and unlocks said guide bolt.

10. A method of engaging a progressive safety device for an elevator having an elevator car and a counterweight being guided and movable on guide rails, the elevator car or the counterweight being arrestable on the guide rails by a brake unit operated by an actuating unit, comprising the steps of:

a. holding an actuating arm of the actuating unit in a locked position;

b. moving the actuating arm from the locked position into frictional engagement with one of the guide rails; and c. moving brake shoes of the brake unit into contact with the guide rail by further movement of the frictionally engaged actuating arm and the elevator car relative to the guide rail.

* * * * *